US009017025B2

(12) United States Patent
Lee

(10) Patent No.: US 9,017,025 B2
(45) Date of Patent: Apr. 28, 2015

(54) SERPENTINE COOLING CIRCUIT WITH T-SHAPED PARTITIONS IN A TURBINE AIRFOIL

(75) Inventor: Ching-Pang Lee, Cincinnati, OH (US)

(73) Assignees: Siemens Energy, Inc., Orlando, FL (US); Mikro Systems, Inc., Charlottesville, VA (US)

( * ) Notice: Subject to any disclaimer, the term of this patent is extended or adjusted under 35 U.S.C. 154(b) by 537 days.

(21) Appl. No.: 13/092,303

(22) Filed: Apr. 22, 2011

(65) Prior Publication Data

US 2012/0269648 A1 Oct. 25, 2012

(51) Int. Cl.
*F01D 5/18* (2006.01)

(52) U.S. Cl.
CPC ..... *F01D 5/187* (2013.01); *F05D 2250/185* (2013.01); *F05D 2260/2212* (2013.01); *F05D 2210/33* (2013.01)

(58) Field of Classification Search
USPC ..... 415/115; 416/97 R, 96 R, 95
See application file for complete search history.

(56) References Cited

U.S. PATENT DOCUMENTS

| | | | | |
|---|---|---|---|---|
| 5,356,265 | A * | 10/1994 | Kercher | 416/97 R |
| 5,484,258 | A | 1/1996 | Isburgh et al. | |
| 5,486,090 | A | 1/1996 | Thompson et al. | |
| 5,660,524 | A * | 8/1997 | Lee et al. | 416/97 R |
| 5,971,708 | A | 10/1999 | Lee | |
| 6,099,252 | A | 8/2000 | Manning et al. | |
| 6,206,638 | B1 * | 3/2001 | Glynn et al. | 416/97 R |
| 6,273,682 | B1 | 8/2001 | Lee | |
| 6,984,103 | B2 | 1/2006 | Lee et al. | |
| 7,097,426 | B2 | 8/2006 | Lee et al. | |
| 7,131,818 | B2 | 11/2006 | Cunha et al. | |
| 7,296,972 | B2 | 11/2007 | Liang | |
| 7,296,973 | B2 | 11/2007 | Lee et al. | |
| 7,347,671 | B2 | 3/2008 | Dorling et al. | |
| 7,527,474 | B1 | 5/2009 | Liang | |
| 7,534,089 | B2 | 5/2009 | Liang | |
| 7,549,843 | B2 | 6/2009 | Liang | |
| 7,686,581 | B2 | 3/2010 | Brittingham et al. | |
| 7,695,245 | B1 | 4/2010 | Liang | |
| 7,699,583 | B2 | 4/2010 | Cunha | |
| 7,704,046 | B1 | 4/2010 | Liang | |
| 7,713,027 | B2 | 5/2010 | Cherolis et al. | |
| 7,717,675 | B1 | 5/2010 | Liang | |
| 2004/0096313 | A1 * | 5/2004 | Harvey et al. | 415/115 |
| 2007/0104576 | A1 | 5/2007 | Cunha et al. | |
| 2008/0118366 | A1 | 5/2008 | Correia et al. | |
| 2009/0060715 | A1 * | 3/2009 | Kopmels | 415/115 |
| 2009/0285683 | A1 | 11/2009 | Pietraszkiewicz et al. | |

* cited by examiner

*Primary Examiner* — Nathaniel Wiehe
*Assistant Examiner* — Kayla McCaffrey

(57) ABSTRACT

A serpentine cooling circuit (AFT) in a turbine airfoil (34A) starting from a radial feed channel (C1), and progressing axially (65) in alternating tangential directions through interconnected channels (C1, C2, C3) formed between partitions (T1, T2, J1). At least one of the partitions (T1, T2) has a T-shaped transverse section, with a base portion (67) extending from a suction or pressure side wall (64, 62) of the airfoil, and a crossing portion (68, 69) parallel to, and not directly attached to, the opposite pressure or suction side wall (62, 64). Each crossing portion bounds a near-wall passage (N1, N2) adjacent to the opposite pressure or suction side wall (62, 64). Each near-wall passage may have a smaller flow aperture area than one, or each, of two adjacent connected channels (C1, C2, C3). The serpentine circuit (AFT) may follow a forward cooling circuit (FWD) in the airfoil (34A).

8 Claims, 8 Drawing Sheets

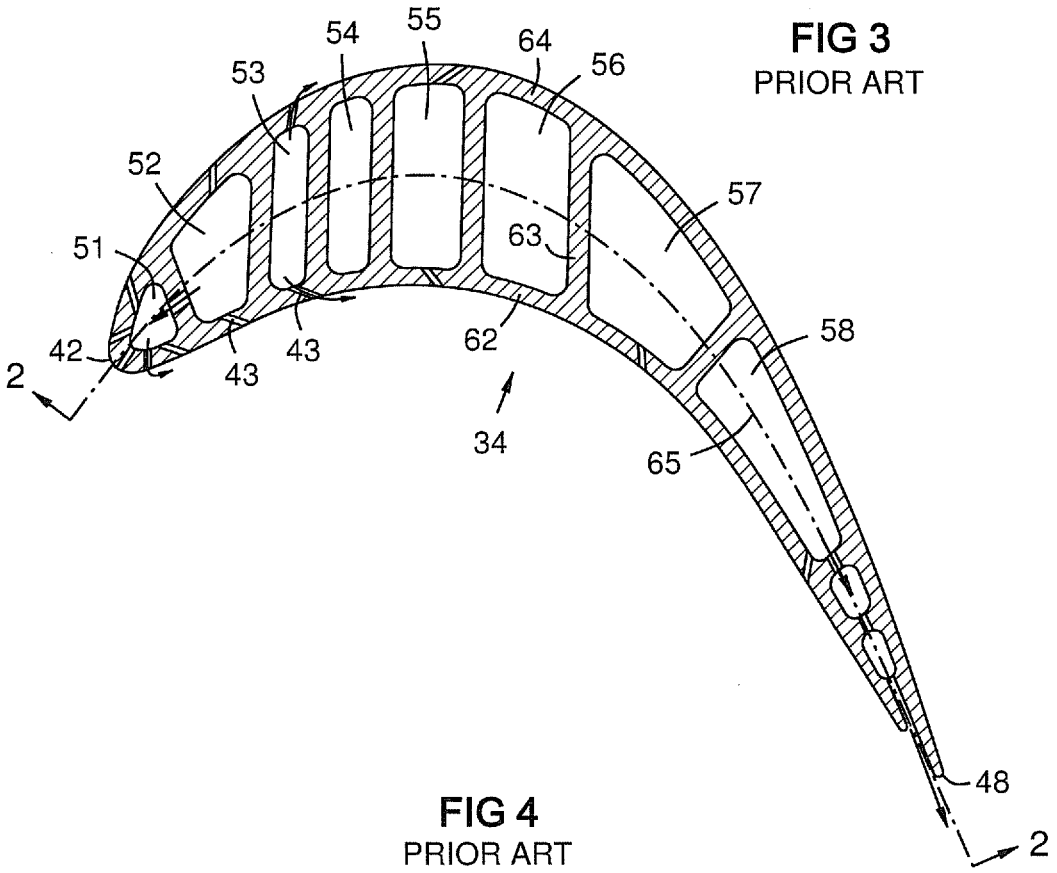
FIG 3
PRIOR ART
FIG 4
PRIOR ART
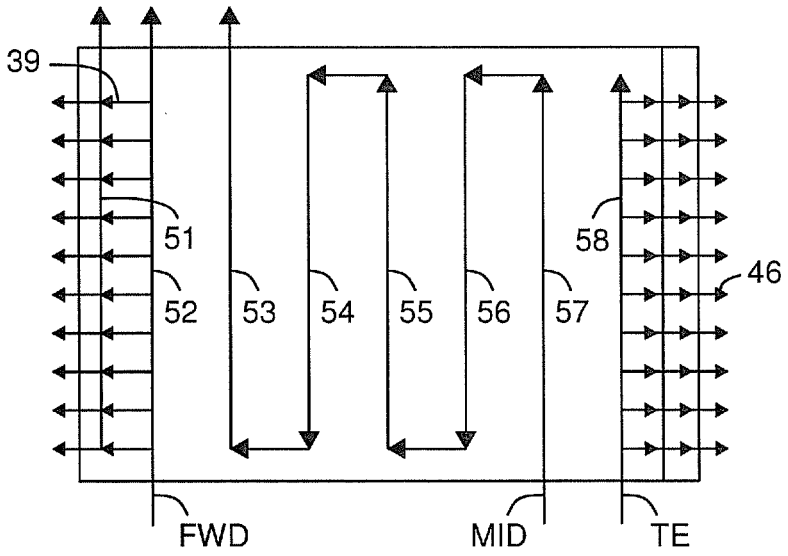

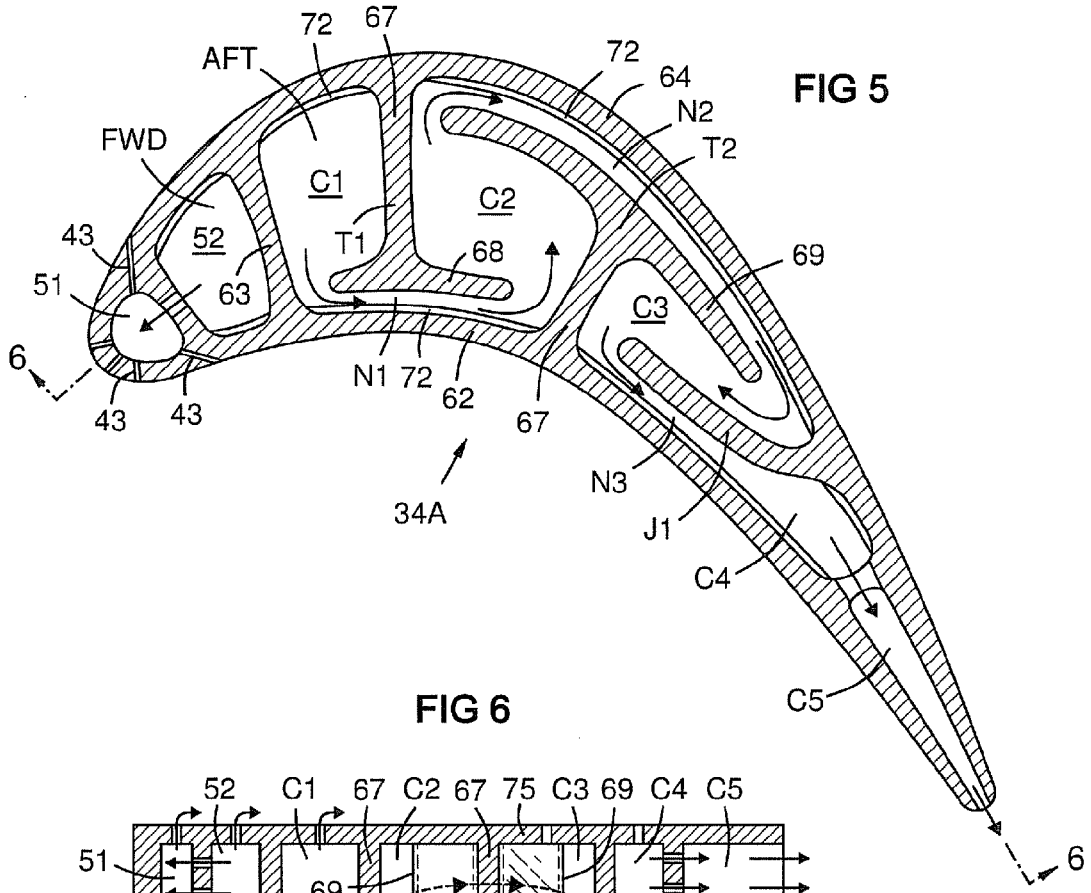
FIG 5
FIG 6
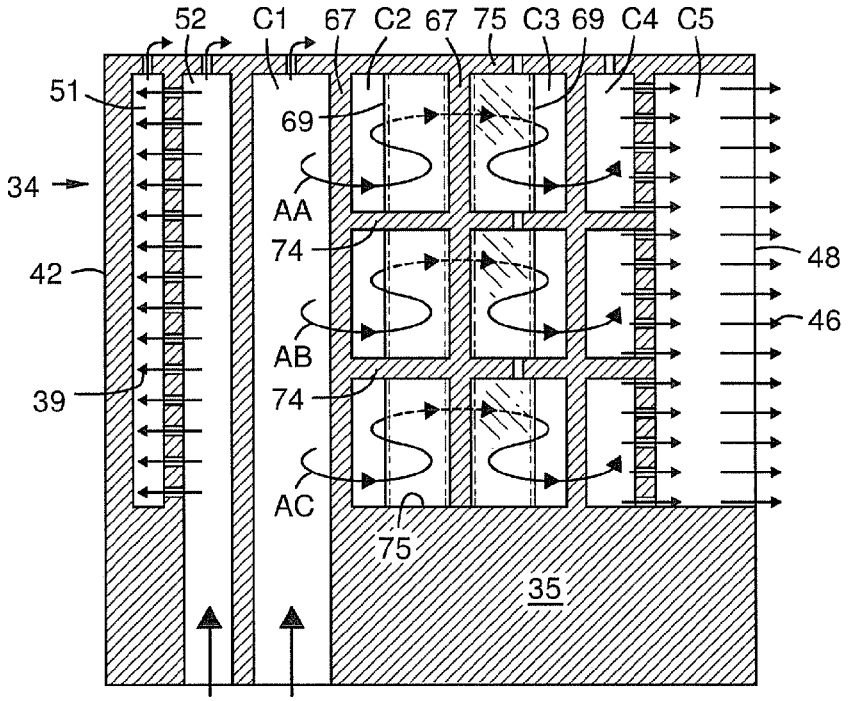

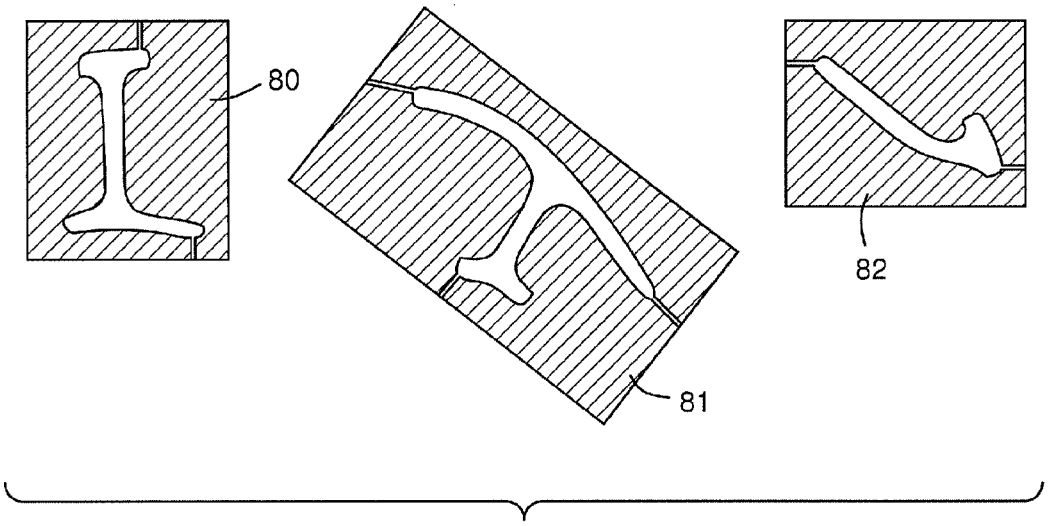
FIG 7
FIG 8
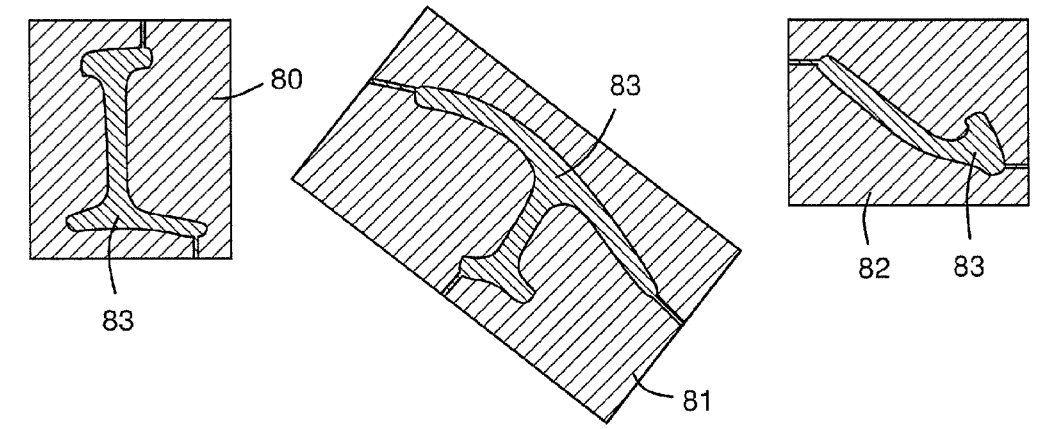

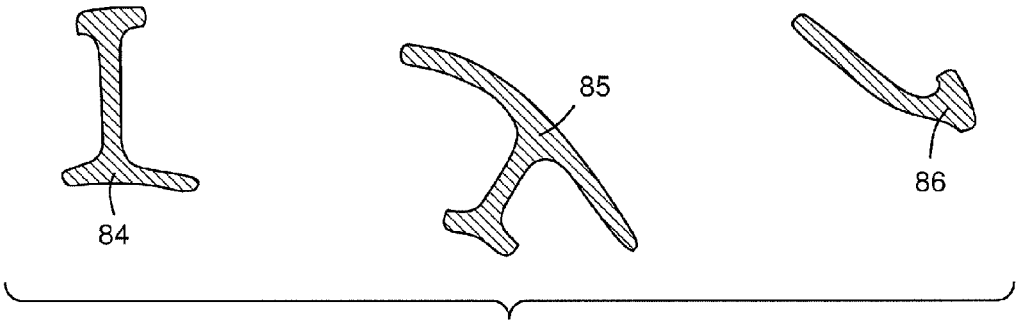
FIG 9
FIG 10
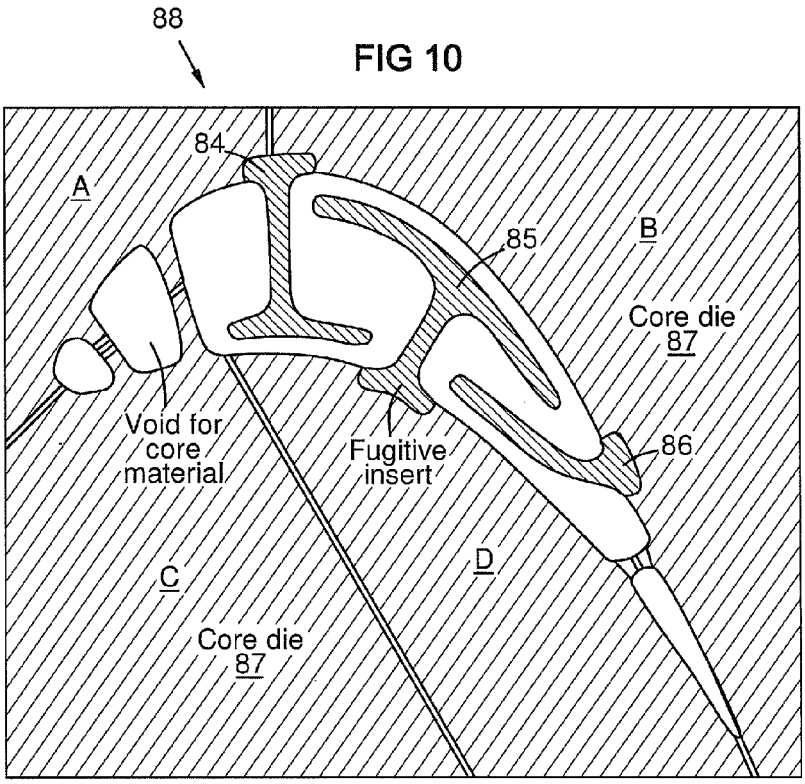

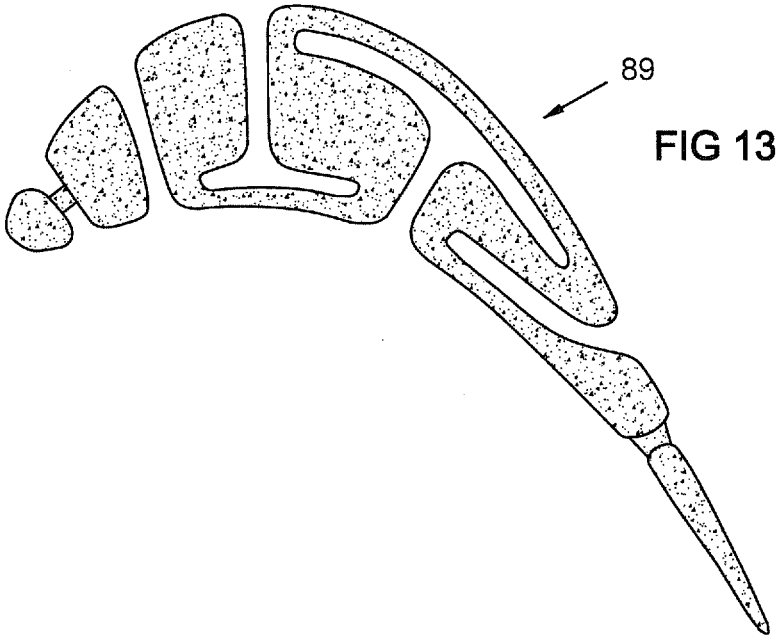
FIG 13
FIG 14
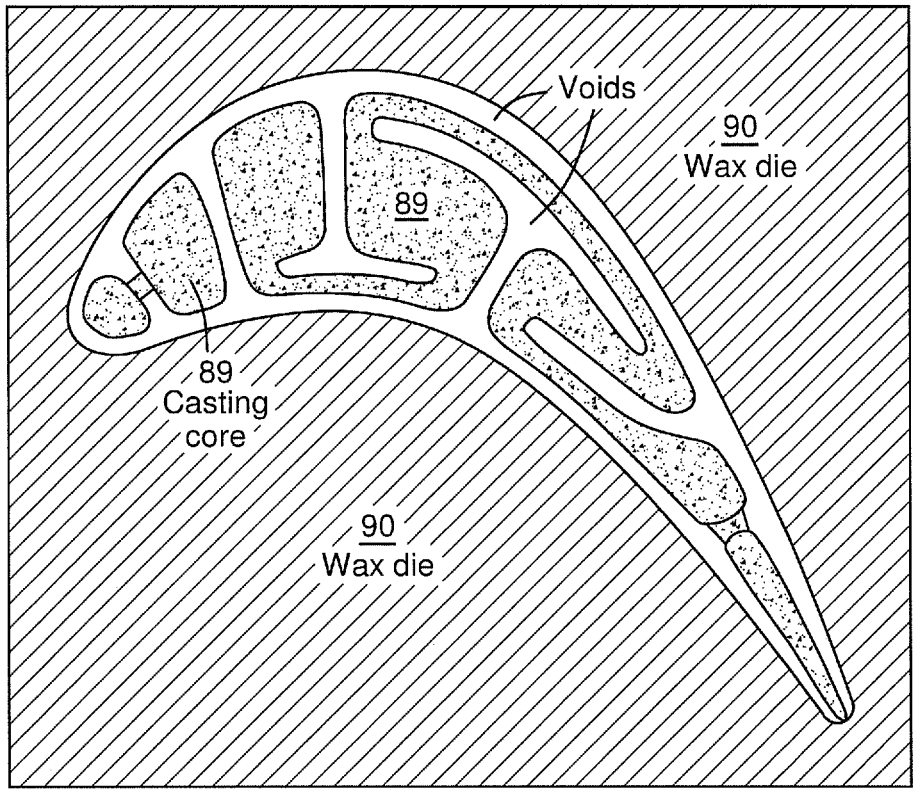

SERPENTINE COOLING CIRCUIT WITH T-SHAPED PARTITIONS IN A TURBINE AIRFOIL

FIELD OF THE INVENTION

This invention relates to serpentine cooling circuits, near-wall cooling efficiency, and thermal gradient stress reduction in turbine airfoils.

BACKGROUND OF THE INVENTION

Gas turbine blades operate at temperatures up to about 1500° C. They are commonly cooled by circulating air through channels in the blade. This cooling process must be efficient in order to maximize turbine efficiency by minimizing the coolant flow requirement.

Serpentine cooling circuits route cooling air in alternating directions to fully utilize its cooling capacity before it exits the blade. Such circuits have a series of channels bounded between the external airfoil walls and internal partition walls. The external walls are in direct contact with hot combustion gases, and need cooling to maintain adequate material life. The interior surfaces of the external hot walls are the primary cooling surfaces. The internal partition walls are extensions from the hot walls, and have no direct contact with the hot gas, so they are much cooler. The surfaces of the internal partition walls serve as extended secondary cooling surfaces for the external hot walls by conduction. Cooling air flows through the serpentine cooling channels and picks up heat from the walls through forced convection. The effectiveness of this heat transfer rate is inversely proportional to the thermal boundary layer thickness. Turbulators are commonly cast on the interior surfaces of the hot external walls to promote flow turbulence and reduce the thickness of the thermal boundary layer for better convective heat transfer. The high-temperature alloys used in turbine blades generally have low thermal conductivity, and therefore have low efficiency in heat transfer. To adequately cool a turbine blade, it is important to have a sufficient area of directly cooled primary surface combined with high efficiency of heat transfer.

A turbine blade airfoil has a larger thickness near the mid-chord region. In order to maintain sufficient speed of the cooling air inside cooling channels, the cooling channels near the maximum airfoil thickness become narrow. These narrow channels have small primary cooling surfaces on the hot walls, and large secondary cooling surfaces on the partition walls. The small primary cooling surfaces limit the size of the turbulators and their effectiveness. Such narrow channels do not provide efficient convective cooling.

The invention described herein increases the primary cooling surface area on the hot walls. In addition, it reduces thermal gradients between the external walls and the internal partitions, thus reducing thermal stress in the blade structure.

BRIEF DESCRIPTION OF THE DRAWINGS

The invention is explained in the following description in view of the drawings that show:

FIG. 3 is a transverse sectional view taken along line 2-2 of FIG. 2.

FIG. 4 schematically illustrates coolant flow paths from the viewpoint of FIG. 2

FIG. 5 is a transverse sectional view of an airfoil per aspects of the invention.

FIG. 6 schematically illustrates a side sectional view of FIG. 5 sectioned along the mean camber line as indicated by 6-6 of FIG. 5.

FIG. 7 shows dies for casting fugitive inserts that model partition walls of FIG. 5.

FIG. 8 shows the insert dies of FIG. 7 filled with a fugitive material.

FIG. 9 shows fugitive inserts formed by the dies of FIGS. 7 and 8.

FIG. 10 shows the fugitive inserts placed inside a core die to form a composite core die.

FIG. 13 shows the completed ceramic core after removal of the fugitive inserts.

FIG. 14 shows a wax die placed around the ceramic core with voids that model the final turbine blade.

DETAILED DESCRIPTION OF THE INVENTION

Figure 1:
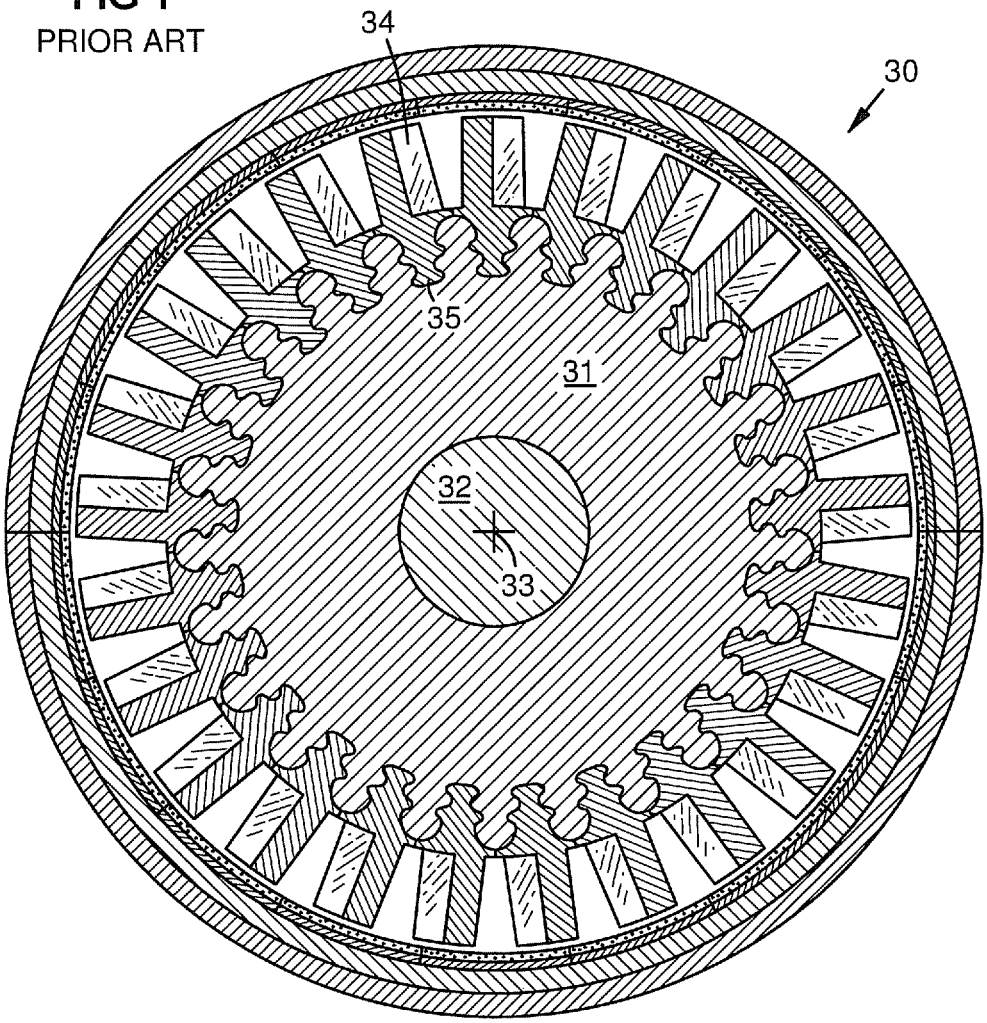
FIG 1 PRIOR ART
FIG. 1 is a conceptual sectional view of a prior art turbine rotor assembly.

FIG. 1 illustrates a rotor assembly 30 of a turbine, including a disc 31 on a shaft 32 with a rotation axis 33. Blade airfoils 34 are attached to the disc by mounting elements 35 such as dovetails, forming a circular array of airfoils around the circumference of the rotating disc. Herein, the term "radial" is relative to the turbine rotation axis 33.

Figure 2:
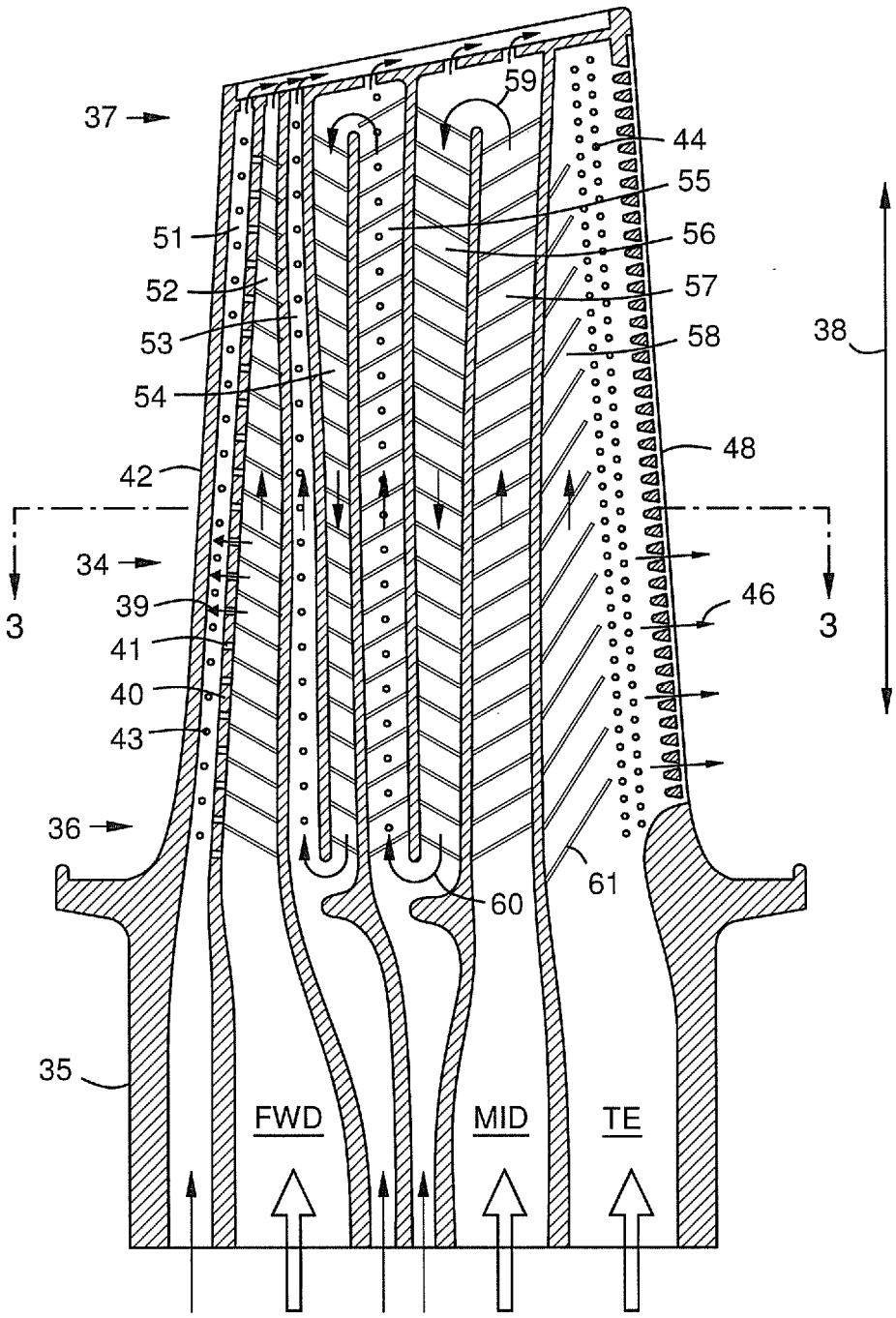
FIG 2 PRIOR ART
FIG. 2 is a side sectional view of a known turbine blade, sectioned along the mean camber line of FIG. 3.

FIG. 2 shows a conventional design of cooled turbine blade, with an airfoil 34 having a span between a root portion 36 and a tip portion 37 in a radial orientation 38 with respect to the rotation axis 33. A mounting element 35 is attached to, or formed integrally with, the root portion 36. Three cooling circuits, FWD, MID, and TE are shown in the airfoil. The forward circuit FWD has two radial channels 51, 52, with an impingement partition 40 between them. Impingement holes 41 direct impingement jets 39 against the leading edge wall 42. The coolant then flows in the forward channel 51, and exits film cooling holes 43 on the leading edge 42 and the blade tip. The MID circuit is a 5-pass serpentine circuit that starts from a coolant feed channel 57, and progresses forward in alternating radial directions through channels 56, 55, 54, and 53. The radial channels of the MID circuit are interconnected 59, 60 at alternate ends to guide the coolant in alternating radial directions. The inner surfaces of the pressure and suction side walls within the radial channels may be lined with turbulators 61, such as angled ridges as shown, to increase cooling efficiency by disrupting the thermal boundary layer. The trailing edge circuit TE routes coolant through a radial channel 58, from which it passes through heat transfer and metering elements, such as small channels and pins 44, then exits through openings 46 at the trailing edge 48.

FIG. 3 is a transverse sectional view of the airfoil 34 of FIG. 2. Each channel 53-57 in the MID circuit is bounded between the pressure sidewall 62, the suction sidewall 64, and two partition walls 63 connected between the pressure and suction sidewalls. The MID circuit progresses from channel to channel forward from the feed channel 57 along a mean camber line 65.

The cross-sections of the MID channels 57, 56, 55, 54, 53 progress from a higher aspect ratio (length/width) at channel 57 to a lower aspect ratio at channel 53 to maintain flow speed in view of increasing airfoil thickness along the circuit. In most of the MID channels the distance between the pressure sidewall 62 and the suction sidewall 64 is greater than the distance between partition walls 63, so they have an aspect ratio of less than 1.0. This reduces cooling efficiency, because the hot wall area in these channels is relatively small, and because three boundary layers interact at the hot walls 62, 64 in these narrow channels.

FIG. 4 schematically illustrates the flow paths of the cooling circuits FWD, MID, and TE of FIGS. 2 and 3, as sectioned along the mean camber line 65 of FIG. 3.

FIG. 5 is a transverse sectional view of an airfoil 34A per aspects of the invention. A forward circuit FWD may be provided as in the prior art. An aft serpentine circuit AFT starts from a radial feed channel C1, then progresses in alternating tangential directions through channels C2, C3, and C4, and may exit through a trailing edge channel C5. T-shaped partitions T1, T2 bound one or more of the AFT channels. Each T-shaped partition T1, T2 has a base portion 67 attached to a pressure or suction side wall 62, 64, and a respective crossing portion 68, 69 that is parallel to the opposite suction or pressure side wall. The crossing portion is the top or cross of the "T". The crossing portions 68, 69 may not be directly attached to the respective near pressure or suction side wall 62, 64 as shown, thus eliminating thermal gradient stress of such attachment.

The combination of interior T-shaped partitions T1, T2 and exterior airfoil walls 62, 64 forms axial-flow near-wall cooling passages N1, N2 that cover much of the inner surfaces of the pressure and suction side walls 62, 64. Herein "axial" means oriented generally along the mean camber line 65 (FIG. 3) of the airfoil, which is a line or curve midway between the pressure and suction sides of the airfoil in a transverse plane of the airfoil. The crossing portions 68, 69 overlap each other axially across the channel C2, as do the respective near-wall passages N1, N2.

Another near-wall passage N3 may be formed by a partition J1 that may be generally J-shaped as shown. J1 extends from the pressure or suction side wall opposite the near-wall passage N3, and overlaps axially with the previous crossing portion 69, such that near-wall passage N3 axially overlaps the previous near-wall passage N2.

The near-wall passages N1, N2 may be narrower than one, or each, of two adjacent channels C1, C2, C3. This produces higher heat transfer coefficients in the near-wall passages N1, N2 than in the adjacent connected channels C1, C2, C3. The coolant flows faster through the near-wall passages N1, N2, reducing the boundary layer thickness and increasing the mixing rate. The near-wall passages N1, N2 may each have a smaller flow aperture area than one, or each, of the adjacent connected channels. The flow aperture area is the cross sectional area of a flow channel or passage on a section plane transverse to the flow direction. For example, near-wall passage N1 may have a smaller flow aperture area than each of the connected channels C1, C2. Near-wall passage N2 may have a smaller flow aperture area than each of the connected channels C2, C3. Turbulators 72 such as ridges, bumps, or dimples may be provided on the inner surfaces of the hot walls 62, 64 to further increase heat transfer. The T-shaped partitions T1, T2 may lack turbulators in order to concentrate cooling on the primary cooling surfaces for maximum efficiency. Film cooling holes 43 may be provided at any location on the airfoil exterior walls.

FIG. 6 schematically shows a side sectional view of the circuits of FIG. 5, sectioned along the mean camber line indicated by 6-6 of FIG. 5. Multiple radial tiers of AFT circuits AA, AB, AC may be formed by transverse airfoil partitions 74. Although three AFT circuits AA, AB, AC are shown, any number can be used, including a single tier with no transverse partitions 74. Multiple tiers allow individual flow control per radial section, and provide additional structural support. Each T-shaped partition T1, T2 may be connected between upper and lower bounding walls, where "upper" and "lower" mean radially outer and inner respectively. For circuit AA, the upper/lower bounding walls are the blade tip wall 75 and a transverse partition 74. For circuit AB, the upper/lower bounding walls are two transverse partitions 74. For circuit AC, the upper/lower bounding walls are a transverse partition 74 and a blade root wall 75.

In FIGS. 5 and 6 the first T-shaped partition T1 in the AFT flow sequence extends from the suction side wall 64, such that the first near-wall passage N1 covers a forward portion of the pressure side wall 62 in the AFT circuit. Alternately (not shown) the first T-shaped partition in the flow sequence may extend from the pressure side wall 62, such that the first near-wall passage covers a forward portion of the suction side wall 64 in the AFT circuit. One or more T-shaped partitions may be provided in the AFT circuit, and especially two or more. The AFT circuit may include the trailing edge channel C5 as shown, or the AFT circuit may terminate prior to the trailing edge channel C5. The AFT circuit may start aft of the radial feed channel 52 of a FWD circuit as shown, or the radial feed channel C1 of the AFT circuit may serve as a radial feed channel for both the FWD and AFT circuits. Benefits to the illustrated embodiment of these options include: 1) Separate radial feed channels 52 and C1 provide individual flow control of the FWD and AFT circuits; 2) Providing a bridge partition 63 as shown between the two radial feed channels 52 and C1 provides structural strength to the leading edge area; 3) The sequentially first near-wall passage N1 is on the hotter forward end of the hotter pressure side of the airfoil at the beginning of the AFT circuit where the coolant is coolest; 4) Providing two adjacent T-shaped partitions provides axially overlapping near-wall passages N1, N2 that can cover a large portion of the airfoil.

Conventional cooled turbine blades are often cast by a lost wax process that creates an alloy pour void between a removable ceramic core and a removable ceramic shell. The ceramic core is formed in a multi-piece core die that is opened from outside. A limitation of this process is that all of the internal partition walls must be oriented along a common pull plane.

The present turbine blade has T-shaped partitions with no common pull plane, so the conventional casting setup cannot be used. Next described is a method for fabricating the present turbine blade by providing fugitive inserts inside a composite core die to form a ceramic core. The fugitive inserts are removed from the ceramic core before the waxing and shelling processes for casting. The fugitive inserts can be made with simple tooling and low-cost materials. The finished ceramic core can then be used for conventional casting.

FIGS. 7-9 show steps for fabricating the fugitive inserts. FIG. 7 shows dies 80, 81, 82 for casting three exemplary fugitive inserts that model the partition walls T1, T2, and J1 respectively. FIG. 8 shows these dies filled with a fugitive material 83 such as wax, plastic, resin, or other low-melting-point material that supports ceramic injection inside the airfoil core die. FIG. 9 shows fugitive inserts 84, 85, 86 after opening the respective dies 80, 81, 82.

Figure 11:
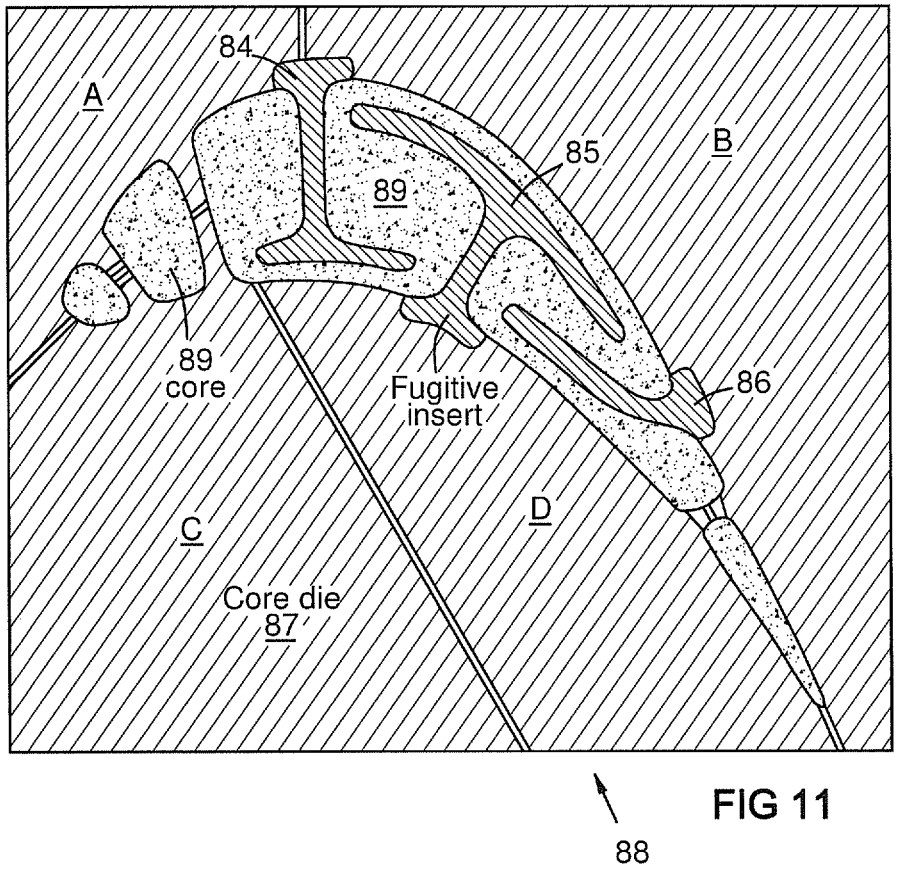
FIG. 11 shows a ceramic core material injected into the composite core die.
Figure 12:
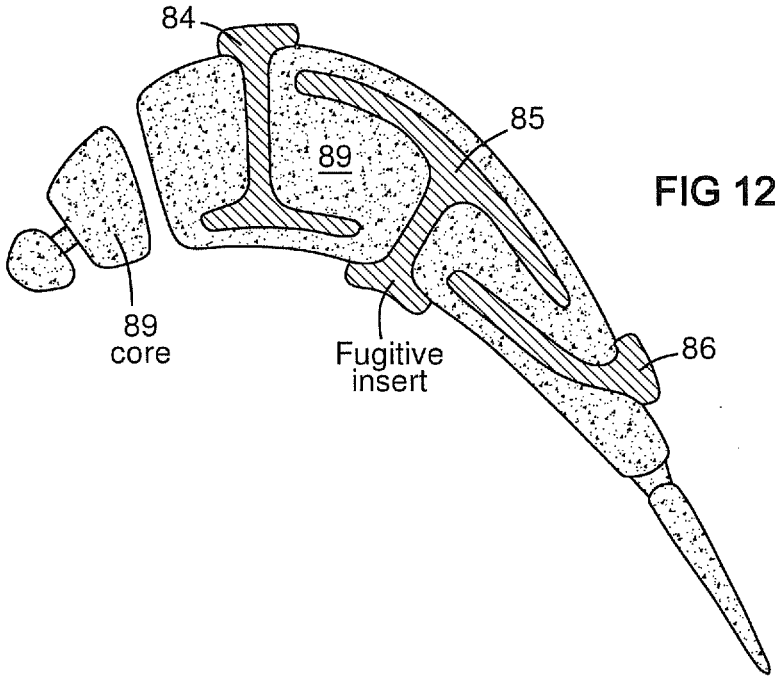
FIG. 12 shows the ceramic core with fugitive inserts after removal of the core die.

FIG. 10 shows the fugitive inserts placed inside a core die 87 to form a composite core die 88 for injection of a ceramic core 89 material as shown in FIG. 11. For illustration, the core die is made of parts A, B, C, and D. FIG. 12 shows the resulting ceramic core 89 with fugitive inserts 84, 85, 86 after removal of the core die 87. FIG. 13 shows the completed ceramic core 89 after removal of the fugitive inserts by heat or other known means. FIG. 14 shows a wax die 90 placed around the ceramic core.

Conventional waxing and shelling may now be used to form a casting mold. The remaining steps may include: 1) Injecting wax into voids in the wax die 90 to form a wax model of the blade with the ceramic core 89 inside the wax model; 2) Removing the wax die 90, leaving the wax model with the ceramic core 89; 3) Forming a ceramic shell around the wax model; 4) Removing the wax to leave a ceramic casting mold with the ceramic core 89; 5) Pouring molten alloy into the ceramic casting mold, filling the void left by the wax model; 6) Removing the ceramic shell; and 7) Removing the ceramic core chemically, leaving the final cast blade. This is a reliable and cost effective method to make the present turbine blade with the T-shaped partitions.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A turbine airfoil with a radial span, comprising:

a serpentine cooling circuit comprising an axial progression of interconnected radial channels between T-shaped partitions that have respective base portions extending from alternate pressure and suction side walls of the airfoil, and have respective crossing portions that bound respective near-wall passages adjacent to the suction and pressure side wall opposite the base portion, wherein the T-shaped partitions each have a "T" shape in a plane transverse to the radial span, and a first one of the channels in a flow sequence order is a radial feed channel, and further comprising a generally J-shaped partition with an end extending forward from an external wall of the airfoil aft of a last one of the T-shaped partitions in the flow sequence, wherein the end of the generally J-shaped partition axially overlaps the crossing portion of the last T-shaped partition.

2. The turbine airfoil of claim 1, wherein each of the near-wall passages has a smaller flow aperture area than each of two directly adjacent channels of the serpentine cooling circuit.

3. The turbine airfoil of claim 2, further comprising a forward radially extending cooling circuit bounded on an aft side by a bridge partition that extends between the pressure and suction side walls of the airfoil;

wherein the bridge partition bounds a forward side of the radial feed channel of the serpentine cooling circuit.

4. The turbine airfoil of claim 3, wherein the serpentine cooling circuit further comprises a radial trailing edge channel with coolant exit holes along a trailing edge of the airfoil aft of the generally J-shaped partition.

5. The turbine airfoil of claim 3, further comprising a transverse wall extending across some of the channels transversely to the radial span and dividing the serpentine cooling circuit into upper and lower sections.

6. The turbine airfoil of claim 3, wherein the base portion of a first one of the T-shaped partitions extends from the suction side wall of the airfoil, and bounds an aft side of the radial feed channel;

the crossing portion of the first T-shaped partition is parallel to the pressure side wall of the airfoil, and is not directly attached thereto;

the base portion of a second one of the T-shaped partitions extends from the pressure side of the airfoil, and bounds an aft side of a second one of the channels; and the crossing portion of the second T-shaped partition is parallel to the suction side wall of the airfoil, and is not directly attached thereto.

7. The turbine airfoil of claim 6, wherein the end of the generally J-shaped partition extends forward from the suction side of the airfoil aft of the second T-shaped partition, axially overlapping the crossing portion thereof, and forming an additional near-wall passage adjacent to the pressure side wall of the airfoil.

8. A turbine airfoil with a radial span, comprising:

a serpentine cooling circuit starting from a radial feed channel and progressing axially in alternating tangential directions between partitions that define a series of interconnected radial channels that progresses axially through the airfoil; wherein at least one of the partitions comprises a T-shaped transverse section;

each T-shaped section comprises a base portion that extends normally from a suction side wall or a pressure side wall of the airfoil;

each T-shaped section further comprises a crossing portion that is parallel to, and is not directly attached to, the pressure side wall or suction side wall that is opposite the base portion of said each T-shaped section;

the crossing portion bounds a near-wall passage adjacent to said opposite pressure side wall or suction side wall;

the near-wall passage has a smaller flow aperture area than either of two adjacent ones of the channels directly connected to the near-wall passage;

wherein the base portion of a first one of the T-shaped partitions extends from the suction side wall of the airfoil, and bounds an aft side of the radial feed channel;

the crossing portion of the first T-shaped partition is parallel to the pressure side wall of the airfoil, and is not directly attached thereto;

the base portion of a second one of the T-shaped partitions extends from the pressure side of the airfoil, and bounds an aft side of a second one of the channels; and the crossing portion of the second T-shaped partition is parallel to the suction side wall of the airfoil, and is not directly attached thereto; and further comprising a generally J-shaped partition with an end extending forward from the suction side of the airfoil aft of the second T-shaped partition, axially overlapping the crossing portion thereof, and forming an additional near-wall passage adjacent to the pressure side wall of the airfoil.

* * * * *